US009801519B2

(12) United States Patent
Reed, Jr. et al.

(10) Patent No.: US 9,801,519 B2
(45) Date of Patent: Oct. 31, 2017

(54) STAIN TREATMENT AND REMOVAL

(71) Applicant: BISSELL Homecare, Inc., Grand Rapids, MI (US)

(72) Inventors: Charles A. Reed, Jr., Rockford, MI (US); Eric J. Hansen, Ada, MI (US); Douglas J. Medema, Belding, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 1007 days.

(21) Appl. No.: 14/063,474

(22) Filed: Oct. 25, 2013

(65) Prior Publication Data

US 2014/0048102 A1 Feb. 20, 2014

Related U.S. Application Data

(62) Division of application No. 12/641,517, filed on Dec. 18, 2009, now Pat. No. 8,567,418.

(60) Provisional application No. 61/139,230, filed on Dec. 19, 2008.

(51) Int. Cl.

| | |
|---|---|
| ***A47L 13/17*** | (2006.01) |
| ***A47L 13/26*** | (2006.01) |
| ***A47L 13/12*** | (2006.01) |
| ***C11D 17/04*** | (2006.01) |

(52) U.S. Cl.

CPC ..... *A47L 13/26* (2013.01); *A47L 13/12* (2013.01); *C11D 17/041* (2013.01)

(58) Field of Classification Search

CPC ..... A47L 13/17; A45D 2200/1045

See application file for complete search history.

(56) References Cited

U.S. PATENT DOCUMENTS

| | | | | |
|---|---|---|---|---|
| 3,463,170 | A | 8/1969 | McCullough | |
| 3,556,667 | A * | 1/1971 | Kaufman | A46B 11/0041 15/114 |
| 4,148,318 | A | 4/1979 | Meyer | |
| 4,351,081 | A | 9/1982 | Tarkinson | |
| 4,469,463 | A | 9/1984 | Van Overloop | |
| 4,730,949 | A * | 3/1988 | Wilson | A46B 11/001 15/106 |
| 4,903,365 | A | 2/1990 | Kaufman | |
| 5,003,659 | A | 4/1991 | Paepke | |
| 5,147,337 | A | 9/1992 | Plone | |
| 5,330,075 | A | 7/1994 | Brown, Sr. | |
| 5,724,765 | A | 3/1998 | Wegner | |
| 5,772,346 | A | 6/1998 | Edwards | |

(Continued)

FOREIGN PATENT DOCUMENTS

| | | | |
|---|---|---|---|
| CN | 101150976 | A | 3/2008 |
| GB | 715449 | A | 9/1954 |

*Primary Examiner* — Michael Kornakov
*Assistant Examiner* — Ryan Coleman
(74) *Attorney, Agent, or Firm* — McGarry Bair PC

(57) ABSTRACT

A package for delivering a cleaning solution to a surface to be cleaned includes a sealed packet having a cleaning solution therein with at least a portion of an outer lower surface thereof having at least one weakened, frangible area that is adapted to rupture when a predetermined pressure is applied to an upper surface of the packet. The cleaning solution in the packet can be discharged through the frangible areas when the packet is positioned on a surface and the predetermined pressure is applied to the packet to rupture the packet.

14 Claims, 8 Drawing Sheets

(56) References Cited

U.S. PATENT DOCUMENTS

| | | | | |
|---|---|---|---|---|
| 6,032,314 | A * | 3/2000 | Bowd | A47L 15/0065 15/104.92 |
| 2002/0077266 | A1 | 6/2002 | Gabriel et al. | |
| 2004/0101347 | A1* | 5/2004 | Beard | A47L 1/15 401/139 |
| 2004/0234711 | A1 | 11/2004 | Young | |
| 2005/0155628 | A1* | 7/2005 | Kilkenny | A01N 37/36 134/6 |
| 2005/0244211 | A1 | 11/2005 | Brunner et al. | |
| 2006/0191416 | A1* | 8/2006 | Hirota | A47L 7/04 96/108 |
| 2007/0048063 | A1 | 3/2007 | Bauer et al. | |
| 2007/0119009 | A1 | 5/2007 | Sampaio | |
| 2007/0292195 | A1* | 12/2007 | May | A45D 34/04 401/134 |

* cited by examiner

STAIN TREATMENT AND REMOVAL

CROSS REFERENCE TO RELATED APPLICATIONS

This application is a divisional of U.S. application Ser. No. 12/641,517, filed Dec. 18, 2009, now U.S. Pat. No. 8,567,418, issued Oct. 29, 2013, which claims the benefit of U.S. Provisional Application No. 61/139,230, filed Dec. 19, 2008, both of which are hereby incorporated by reference in its entirety.

BACKGROUND OF THE INVENTION

Field of the Invention

The invention relates to methods and articles for applying liquid stain removal and treatment chemistries to a surface to be cleaned.

Description of Related Art

Traditional stain removal and treatment chemistries typically require a user to apply a solution to a surface to be cleaned, wait some predetermined amount of time and then return to remove the soiled and excess liquid. Application can often require the user to scrub or rub the solution into the surface and the removal step can involve blotting, wiping, rinsing, vacuuming and any combination thereof. These steps can be labor intensive and expose the user's hands to the soiled and excess liquid. In addition, some of the solution may evaporate from the surface during these steps, diminishing the effectiveness of the solution.

U.S. Patent Application No. 20050244211 to Brunner et al. discloses a surface cleaner comprising a reservoir holding a first reactant and a cleaning pad comprising a second reactant. The reservoir can be a compressible reservoir that ruptures under pressure or is pierced by puncture members on the cleaning pad. The first reactant can flow from the ruptured or pierced reservoir into the cleaning pad and react with the second reactant. The reaction can produce an active cleaning agent, such as hydrogen peroxide or a gas to facilitate foaming of the solution as it is applied to the surface being cleaned by the cleaning pad.

U.S. Patent Application No. 20020077266 to Gabriel at al. discloses a stain removal patch having a substrate and a stain receiver. The substrate is a liquid impermeable patch that fully or partially surrounds the stain receiver for limiting the dispersal of a liquid cleaner on the surface being cleaned. The substrate can also have an adhesive to adhere the patch to the surface. The stain receiver is made of an absorbent material in which a liquid cleaner is absorbed. Liquid cleaner is applied to the surface being cleaned through the stain receiver and then the soiled liquid is re-absorbed by the stain receiver.

BRIEF SUMMARY

According to an embodiment of the invention, a package for delivering a cleaning solution to a surface to be cleaned can comprise a sealed packet having a cleaning solution therein with at least a portion of an outer lower surface thereof having at least one weakened, frangible area that is adapted to rupture when a predetermined pressure is applied to an upper surface of the packet. The cleaning solution in the packet can be discharged through the frangible areas when the packet is positioned on a surface and the predetermined pressure is applied to the packet to rupture the packet.

In one embodiment, the packet can have a dome shape defining a single pocket with the frangible areas spaced around a perimeter of the dome shaped packet. Alternatively, the packet can have a dome shape with at least one downwardly extending member defining multiple pockets. The frangible areas can be located on a perimeter of the dome shaped packet and on the at least one downwardly extending member.

In another embodiment, the packet can have an opening and a cover for resealably closing the opening. The cover can have at least one downwardly extending hollow projection for dispensing the cleaning solution from the packet to the surface to be cleaned.

In another embodiment, the packet can have an absorbent material connected thereto. The absorbent material can comprise capillary fingers that protrude towards a surface to be cleaned. The capillary fingers can comprise a resilient hygroscopic gel. The absorbent material can also be a hygroscopic gel.

In another embodiment, the cleaning solution can comprise at least one of a solvent, a surfactant, an enzyme, an oxidizing agent, an anti-soil agent, an anti-stain agent, a disinfectant, a deodorizer, a fragrance or combinations thereof.

In still another embodiment, a method for cleaning a surface can comprise placing a lower surface of a sealed packet having a cleaning solution therein adjacent a surface, the sealed packet having at least one weakened, frangible area for dispensing the cleaning solution when pressure is applied to the packet, applying pressure to the packet to rupture the at least one frangible area, dispensing the cleaning solution from the packet onto the surface to be cleaned when the at least one frangible area is ruptured and removing the soiled cleaning solution from the surface.

In another embodiment, the act of removing the soiled cleaning solution can include contacting the surface with an absorbent material. The method can further comprise dispensing the cleaning solution adjacent a base of the surface and removing the soiled cleaning solution and any excess cleaning solution as it is applied to the surface.

In another embodiment, a package for cleaning a surface comprises a sealed packet having a cleaning solution therein and a dispenser for dispensing the cleaning solution from the packet when pressure is applied to the packet. The cleaning solution in the packet is discharged from the packet by the dispenser directly to the surface to be cleaned along a solution dispensing path when pressure is applied to the packet.

In yet another embodiment, the package further comprises a housing having a pocket configured to receive the packet. The dispenser can comprise at least one hollow piercing projection extending into the pocket. The dispenser can also comprise at least one hollow projection in fluid communication with the at least one piercing projection and extending away from the pocket toward the surface to be cleaned.

In still another embodiment, the packet can comprise at least an outer surface portion thereof with at least one weakened, frangible area for dispensing the cleaning solution to the surface to be cleaned when pressure is applied to the packet.

In another embodiment, an absorbent material can be positioned adjacent the surface to be cleaned, but not within the solution dispensing path, wherein the solution is dispensed directly from the packet to the surface to be cleaned via the solution dispensing path and subsequently absorbed by the absorbent material after application to the surface to be cleaned.

DESCRIPTION OF AN EMBODIMENT OF THE INVENTION

Figure 1:
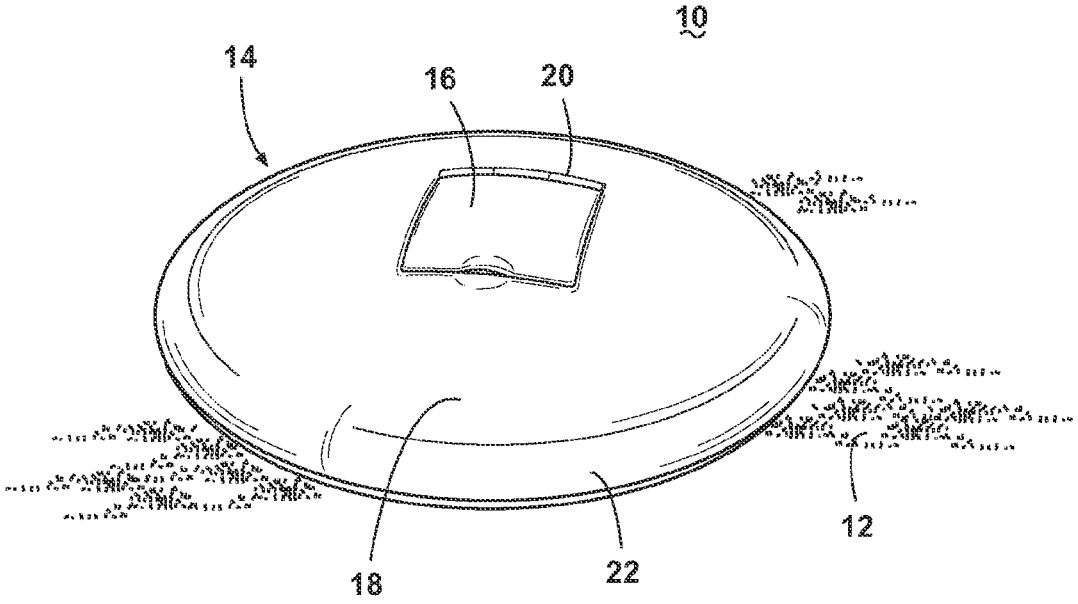
FIG. 1 illustrates a package for delivering a cleaning solution to a surface to be cleaned according to one embodiment of the invention.

FIG. 1 illustrates a package 10 for delivering a cleaning solution to a surface 12, such as a carpet or rug, for example. The package 10 comprises a housing 14 and can have a lid 16 pivotally mounted to an upper portion 18 of the housing 14 by a hinge 20. The housing 14 further has an annular flange 22 extending downward from the upper portion 18 of the housing 14. The annular flange 22 can extend continuously around the perimeter of the upper portion 18 or be formed in discrete sections spaced around the perimeter of the upper portion 18.

Figure 2:
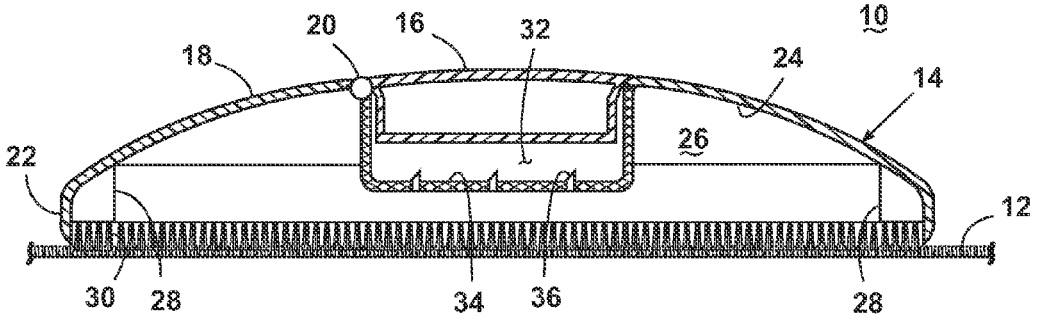
FIG. 2 is a cross-sectional view of the package illustrated in FIG. 1 according to an embodiment of the invention.

Referring now to FIG. 2, the annular flange 22 and a lower face 24 of the upper portion 18 define a chamber 26. One or more securing feet 28 can be disposed adjacent to the annular flange 22 within the chamber 26. The securing feet 28 can extend continuously around the annular flange 22 or one or more securing feet 28 can be spaced intermittently along the annular flange 22. The securing feet 28 can have a plurality of bristles or hook-like teeth 30 for engaging fibers projecting from the surface 12. For example, the securing feet 28 can be provided with a plurality of metal bristles, similar to the metal bristles found on a conventional grill cleaning brush. Another example is a plurality of hook-like teeth, similar to the hook-like teeth used in hook-and-loop fasteners, such as Velcro®, for example. Yet another example comprises a plurality of plastic bristles, similar to the plastic bristles found on conventional hair brushes and vacuum cleaner brush rolls.

The hinged lid 16 provides access to a pocket 32 that extends from the upper portion 18 down into the chamber 26. The lower portion 34 of the pocket 32 can have one or more projections 36 that extend from the pocket 32, through the lower portion 34 and into the chamber 26. The projections 36 can have a hollow, annular shape, providing fluid communication between the contents of the pocket 32 and the chamber 26. The projections 36 can be formed so as to have a sharp upper surface or a sharp point. The bottom portion 34 can comprise a mesh screen, a porous grid or a sieve to further provide fluid communication between the pocket 32 and the chamber 26. The projections 36 and the lower portion 34 can be made from any suitable material such as metal or plastic, for example.

The pocket 32 can be sized so as to receive one or more solution packets 38. The solution packets 38 can comprise a cleaning solution encased within a piercable container made from a suitable plastic, foil, or fiber-based material. The cleaning solution is not limited to any particular type of composition and may comprise a surfactant-based cleaner, an enzyme-based cleaner, an oxidizing composition, an anti-soil and/or anti-stain composition, a botanical or synthetic disinfectant, a deodorizer, a fragrance or any combination thereof.

The solution packets 38 can be provided with solutions tailored for specific cleaning needs, such as for treating a pet stain or for removing a juice stain. The user can also combine one or more solution packets 38 comprising solutions for specific cleaning situations depending on their needs. The packets 38 can be sized so that multiple packets 38 can fit within the pocket 32. The solution packets 38 can be sold individually or as kits with suggestions for use and suitable combinations.

For example, a user can combine a packet designed for removing a juice stain with a packet comprising an anti-soil/anti-stain solution to remove the stain and treat the surface with an anti-soil/anti-stain treatment in one-step. In another example, a user can combine a packet designed for removing a pet stain with a deodorizer packet for removing the pet stain and eliminating pet odor in one step. An individual packet 38 can also be divided into two or more compartments, each compartment containing a different composition.

The package 10 can be used to apply a solution to the surface 12 to remove soil and/or treat the surface 12 by positioning the package 10 over the desired area such that the pocket 32 is generally centered over the desired area. The securing feet 28 can engage the carpet or the rug fibers, also known as the pile, projecting from the backing of the carpet or rug to hold the package 10 in place. For the purposes of this invention, the term "soil" can refer to any foreign substance, stain, soiled cleaning or treatment solution, or combinations thereof with respect to the surface being cleaned or treated. In addition, for the purposes of this invention, the term cleaning can encompass either or both removing and/or degrading or otherwise breaking down soil and treating a surface by the application of one or more cleaning solutions.

The securing feet 28 resist lateral movement of the package 10 and help pull the package 10 towards the surface so that the bottom edge of the annular flange 22 rests on the carpet or rug backing or within the carpet or rug pile. The securing feet 28 facilitate isolation of the chamber 26 from the ambient atmosphere during the cleaning process, which can reduce evaporation. The reduction in evaporation can increase the effectiveness of many types of cleaning compositions, such as enzyme-based compositions or compositions comprising odor-eliminating spores or microbes.

Figure 3A:
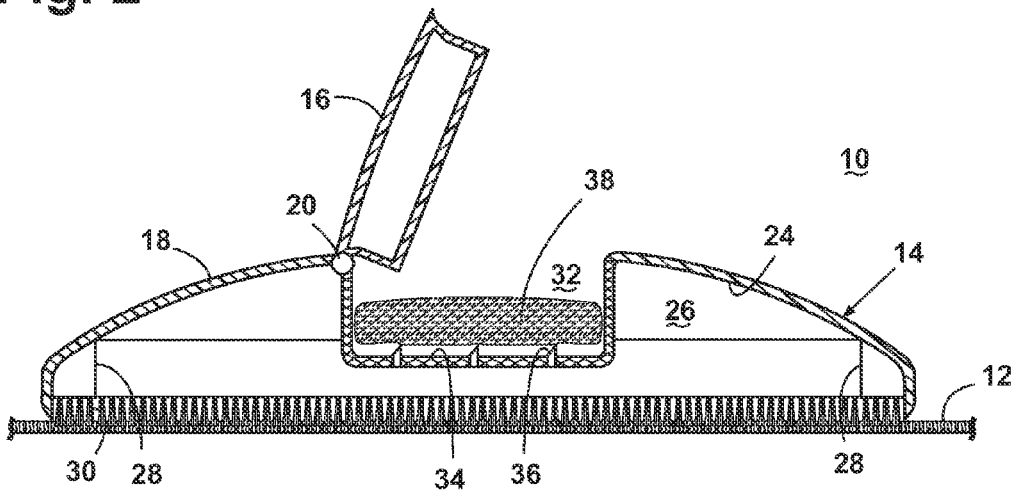
FIG. 3A is a cross-sectional view of the package illustrated in FIG. 1 having a lid in an open position for receiving a solution packet according to an embodiment of the invention.
Figure 3B:
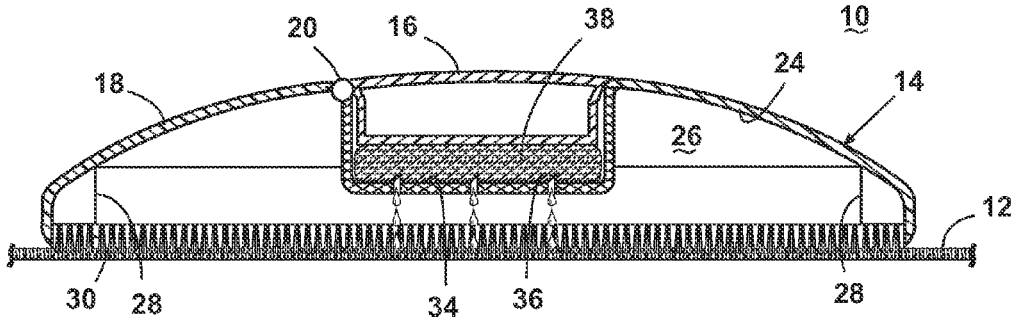
FIG. 3B is a cross-sectional view of the package illustrated in FIG. 1 having a lid in a closed position for compressing a solution packet according to an embodiment of the invention.

As illustrated in FIG. 3A, the lid 16 can be rotated about its hinge 20 to provide access to the pocket 32. One or more solution packets 38 can then be placed within the pocket 32. When the lid 16 is rotated to a closed position, as illustrated in FIG. 3B, the lid 16 can apply pressure to the one or more solution packets 38 placed within the pocket 32 by the user. The pressure from the lid 16 presses the solution packets 38 against the projections 36 which pierce the solution packets 38. The solution is then discharged from the packets 38 through the hollow interior of the projections 36 and dispensed onto the surface 12 below.

It is within the scope of the invention for the package 10 to have a generally circular shape, as illustrated, or the package 10 can have any other suitable shape, such as a generally rectangular, square or any other polygonal shape. While the package 10 is described for use with a soft surface, such as a carpet or rug, the package is suitable for cleaning of any type of hard surface, such as a hard floor, furniture or bathroom surface, for example, or a soft surface, such as upholstery, bedding, garments or drapery, for example.

Figure 4A:
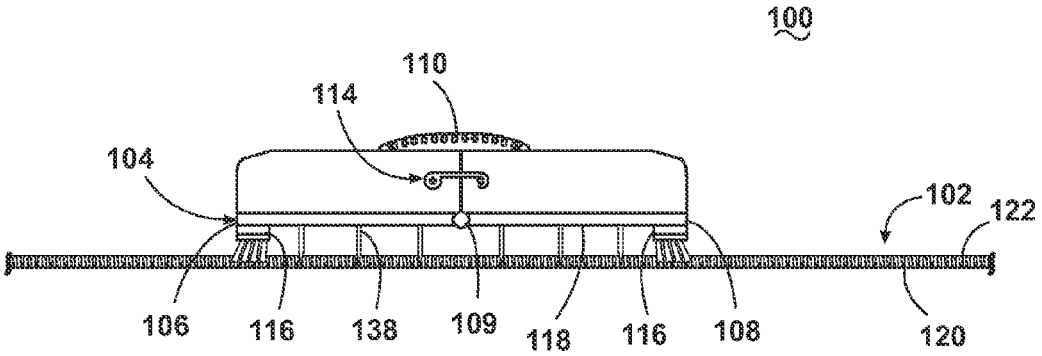
FIG. 4A is a side view of a package for delivering a cleaning solution to a surface in a locked position according to another embodiment of the invention.
Figure 4B:
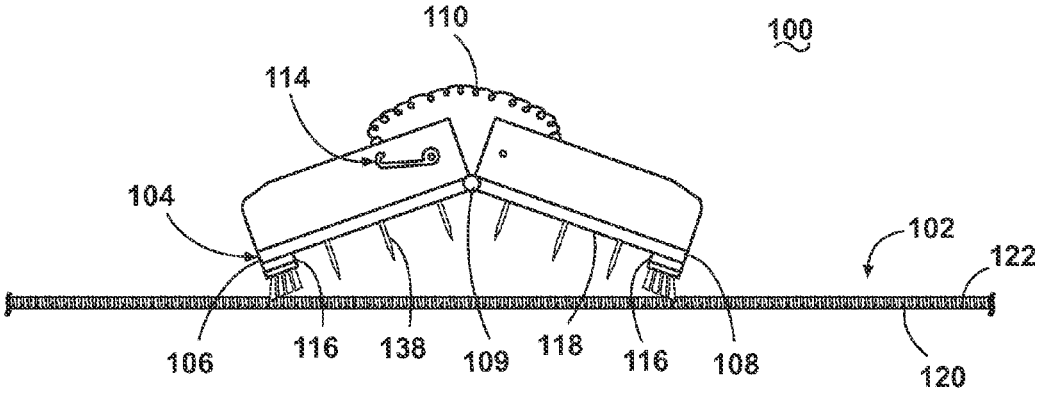
FIG. 4B is a side view of a package for delivering a cleaning solution to a surface to be cleaned in a cocked position according to an embodiment of the invention.
Figure 5:
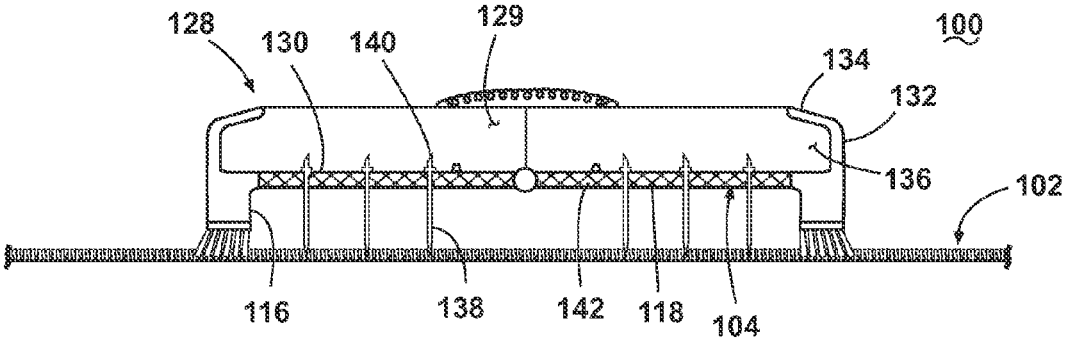
FIG. 5 is a cross-sectional view of the package illustrated in FIGS. 4A and 4B according to an embodiment of the invention.

FIGS. 4 and 5 illustrate a package 100 for dispensing a cleaning solution to a surface 102 according to a second embodiment of the invention. The package 100 can comprise a base 104 that has a first and second portion 106, 108 rotatably connected by a hinge 109. One or more elastic members 110 can extend from the first portion 106 of the base 104 to the second portion 108 across the hinge 109. A latch 114 or other securing mechanism can be provided to keep the base 104 in an unbent, locked position.

A pair of securing feet 116 can extend along a lower face 118 of the base 104. The securing feet 116 can comprise a plurality of bristles, hook-like projections or carpet stretcher pins for engaging fibers that project from the surface 102. The surface 102 can be a rug or carpet, for example, having a backing 120 with a plurality of projecting fibers comprising a pile 122. One example of suitable securing feet 116 comprises a plurality of metal bristles, similar to the metal bristles found on a conventional grill cleaning brush. Another example is a plurality of hook-like teeth, similar to those used in hook-and-loop fasteners, such as Velcro®, for example. Yet another example comprises a plurality of plastic bristles, similar to the plastic bristles found on conventional hair brushes and vacuum cleaner brushrolls.

Referring now to FIG. 5, the package 100 can also be provided with a retention element 128 on an upper face 130 of the base 104. The retention element 128 can comprise an upwardly extending flange 132 extending from the upper face 130 that is connected at its distal end with an inwardly projecting lip 134. The flange 132 and the lip 134 define a retention channel 136. The retention element 128 can extend continuously around the perimeter of the base 104 or it can be provided in discrete sections regularly or irregularly spaced around the perimeter of the base 104. The upper face 130 and the retention element 128 define a pocket 129.

A plurality of hollow needles 138 can project downward from the base 104 towards the surface 102. The needles 138 can be provided with an upwardly projecting hub 140 having a sharpened point (as illustrated). The edges of the needle hub 140 can also be beveled or honed to provide a sharp surface.

The needles 138 can be made from any suitable material, such as plastic or metal, and can project straight from the lower face 118 of the base 104 towards the surface 102. Additionally, one or more needles 138 can be bent as they project from the lower face 118. For example, the needles 138 located in the center of the base 104 can project straight towards the surface 102 while the needles 138 located around the perimeter of the base 104 can be bent an angle. The bent needles 138 can also facilitate securing the package 100 to the surface 102.

The base 104 can further be provided with a porous portion 142 comprising a mesh screen, a porous grid or a sieve for fluidly connecting the pocket 129 with the area below the base 104.

Figure 6:
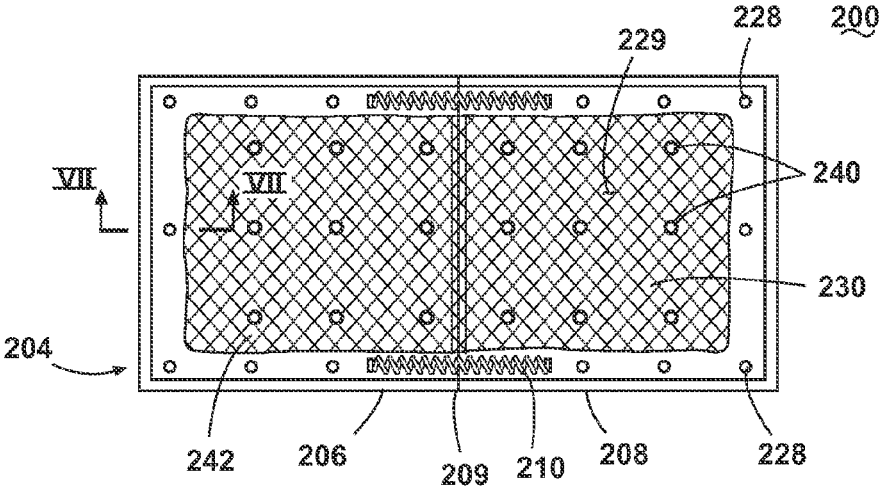
FIG. 6 is a top-down view of a package for delivering a cleaning solution to a surface to be cleaned according to another embodiment of the invention.

FIG. 6 illustrates a package 200 for dispensing a cleaning solution to a surface according to a third embodiment of the invention. The package 200 is similar to the package 100 except for a retention element 228. Therefore, elements in the package 200 similar to those in the package 100 will be numbered with the prefix 200.

The package 200 can comprise a base 204 that has a first and second portion 206, 208 rotatably connected by a hinge 209. One or more elastic members 210 can extend from the first portion 206 of the base 204 to the second portion 208 across the hinge 209. A latch or other securing mechanism can be provided to keep the base 204 in an unbent, locked position (not shown).

A pair of securing feet 216 can extend along a lower face 218 of the base 204. The securing feet 216 can comprise a plurality of bristles, hook-like projections or carpet stretcher pins for engaging fibers that project from the surface 202. The surface 202 can be a rug or carpet, for example, having a backing 220 with a plurality of projecting fibers comprising a pile 222.

The package 200 can also be provided with a retention element 228 in the form of upwardly extending barbs on an upper face 230 of the base 204. The barbs 228 can extend continuously around the perimeter of the base 204 or they can be regularly or irregularly spaced around the perimeter of the base 204. The upper face 230 and the retention element 228 can generally define a pocket area 229.

Figure 7:
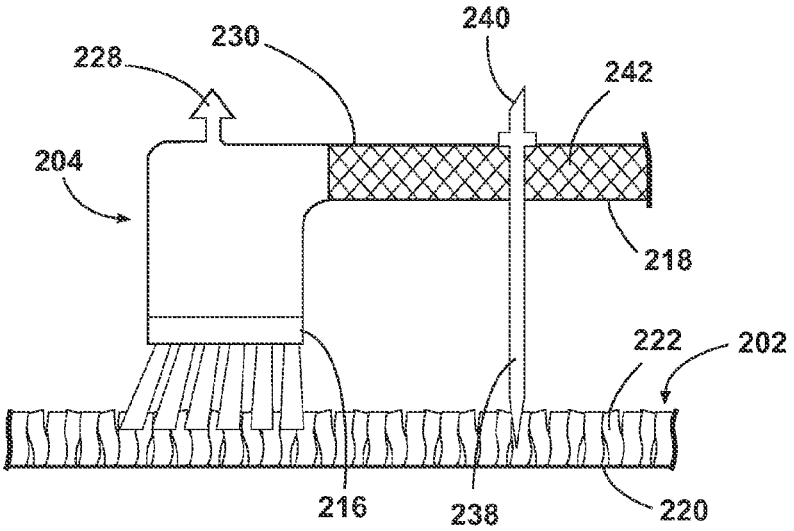
FIG. 7 is a cross-sectional view of the package illustrated in FIG. 6 according to an embodiment of the invention.

As illustrated in FIG. 7, a plurality of hollow needles 238 can project downward from the base 204 towards the surface 202. The needles 238 can be provided with an upwardly projecting hub 240 having a sharpened point (as illustrated). The edges of the needle hub 240 can also be beveled or honed to provide a sharp surface. One or more needles 238 can project straight towards the surface 202 or have an angled lower portion. The needles 238 can be provided with a hub 240 having a sharpened point (as illustrated). The edges of the needle hub 240 can also be beveled or honed to provide a sharp surface. The bent needles 238 can also facilitate securing the package 200 to the surface 202.

The base 204 can further be provided with a porous portion 242 comprising a mesh screen, a porous grid or a sieve for fluidly connecting the pocket 229 with the area below the base 204.

Figure 8:
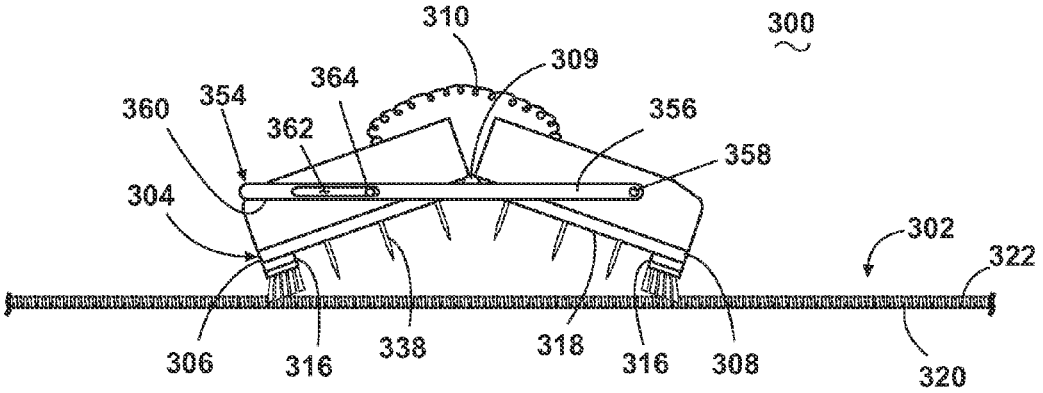
FIG. 8 is a side view of a package for delivering a cleaning solution to a surface to be cleaned according to another embodiment of the invention.

FIG. 8 illustrates a package 300 for dispensing a cleaning solution to a surface 302 according to a fourth embodiment of the invention. The package 300 is similar to the package 100 except for a retention element 328 and a displacement limiter 354. Therefore, elements in the package 300 similar to those in the package 100 will be numbered with the prefix 300.

The package 300 can comprise a base 304 that has a first and second portion 306, 308 rotatably connected by a hinge 309. One or more elastic members 310 can extend from the first portion 306 of the base 304 to the second portion 308 across the hinge 309.

A pair of securing feet 316 can extend along a lower face 318 of the base 304. The securing feet 316 can comprise a plurality of bristles, hook-like projections or carpet stretcher pins for engaging fibers that project from the surface 302. The surface 302 can be a rug or carpet, for example, having a backing 320 with a plurality of projecting fibers comprising a pile 322.

The package 300 can also be provided with a displacement limiter 354. The displacement limiter 354 can comprise a rod 356 that is rotatably connected at a first end 358 with the second portion 308 of the package 300. The rod 356 can be connected at a second end 360 with the first portion 306 by a channel 362 that slidably receives a boss 364 projecting from the first portion 306. While the displacement limiter 354 is illustrated with the invention according to the fourth embodiment, it can be used with any of the embodiments of the invention.

A plurality of hollow needles 338 project downward from the base 304 towards the surface 302. The needles 338 are provided with an upwardly projecting hub 340 having a sharpened point (as illustrated). The edges of the needle hub 340 can also be beveled or honed to provide a sharp surface.

The needles 338 can project straight towards the surface 302 or can project at an acute angle to the vertical axis. The needles 338 can fluidly connect the pocket 329 with the area below the base 304. The needles 338 can be provided with a hub 340 having a sharpened point (as illustrated). The edges of the needle hub 340 can also be beveled or honed to provide a sharp surface. The bent needles 338 can also facilitate securing the package 300 to the surface 302.

Figure 9:
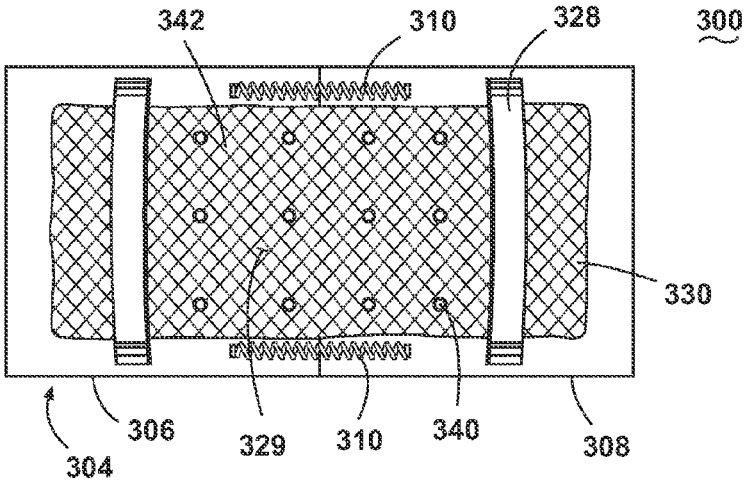
FIG. 9 is a top-down view of a package for delivering a cleaning solution to a surface to be cleaned according to another embodiment of the invention.

Referring now to FIG. 9, the package 300 can further be provided with a retention element 328 in the form of one or more straps on an upper face 330 of the base 304. The retaining straps 328 can be in the form of a single elastic strap or the retaining straps 328 can be in the form of a pair of straps positioned opposite each other on the upper face 330 that can be releasably connected together by any suitable means such as a buckle or Velcro®. The upper face 330 and the retention element 328 generally define a pocket area 329.

The base 304 can further be provided with a porous portion 342 comprising a mesh screen, a porous grid or a sieve for fluidly connecting the pocket 329 with the area below the base 304.

Figure 10:
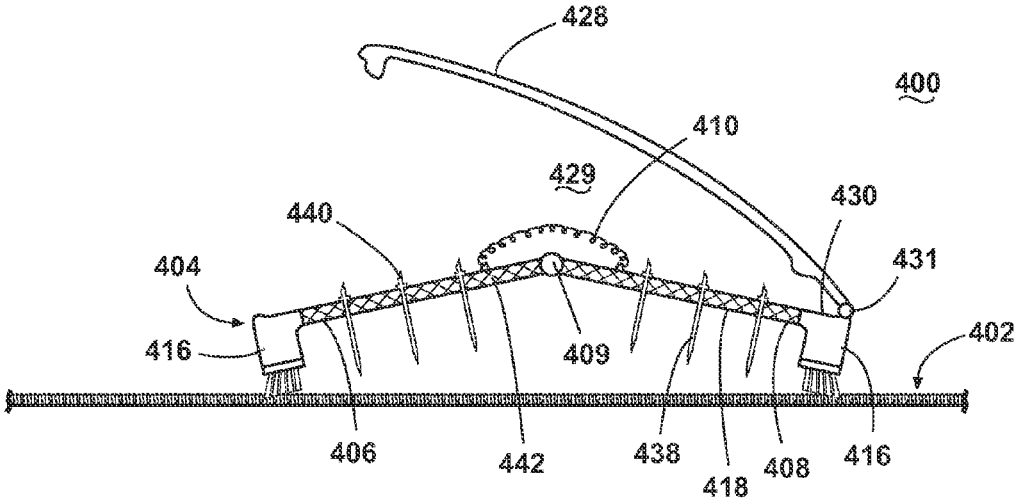
FIG. 10 is a cross-sectional view of a package for delivering a cleaning solution to a surface to be cleaned having a cover according to an embodiment of the invention.

FIG. 10 illustrates a package 400 for dispensing a cleaning solution to a surface according to a fifth embodiment of the invention. Therefore, elements in the package 400 similar to those in the package 100 will be numbered with the prefix "400".

The package 400 can comprise a base 404 that has a first and second portion 406, 408 rotatably connected by a hinge 409. One or more elastic members 410 can extend from the first portion 406 of the base 404 to the second portion 408 across the hinge 409.

A pair of securing feet 416 can extend along a lower face 418 of the base 404. The securing feet 416 can comprise a plurality of bristles, hook-like projections or carpet stretcher pins for engaging fibers that project from the surface 402. The surface 402 can be a rug or carpet having a backing 420 with a plurality of projecting fibers comprising a pile 422.

The package 400 can also be provided with a retention element 428 in the form of a cover coupled with an upper face 430 of the base 404. The retention element 428 can be rotatably coupled with the base 404 by a hinge 431. The upper face 430 and the retention element 428 generally define a pocket 429. The retention element 428 can also be used with any of the preceding packages 100, 200 and 300.

A plurality of hollow needles 438 can project downward from the base 404 towards the surface 402. The needles 438 can be provided with an upwardly projecting hub 440 having a sharpened point (as illustrated). The edges of the needle hub 440 can also be beveled or honed to provide a sharp surface.

The needles 438 can project straight towards the surface 402 or can be positioned at an acute angle to the vertical axis. The needles 438 can be provided with a hub 440 having a sharpened point (as illustrated). The edges of the needle hub 440 can also be beveled or honed to provide a sharp surface. The bent needles 438 can also facilitate securing the package 400 to the surface 402.

The base 404 can further be provided with a porous portion 442 comprising a mesh screen, a porous grid or a sieve for fluidly connecting the pocket 429 with the area below the base 404.

Figure 11:
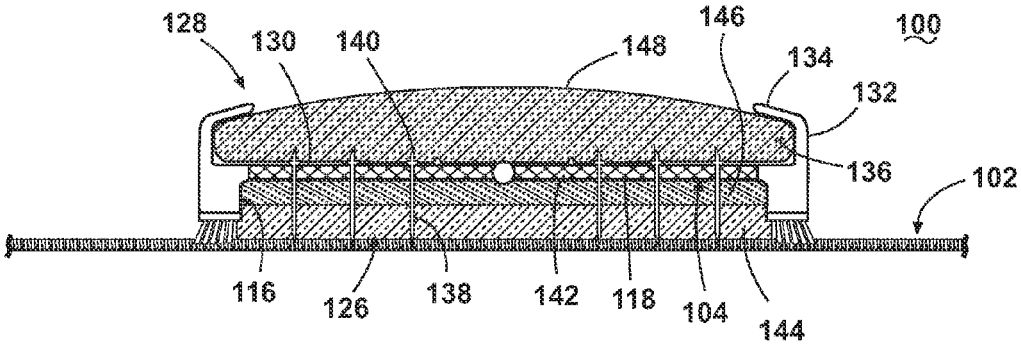
FIG. 11 is a cross-sectional view of the package illustrated in FIGS. 4A and 4B illustrating its use with a solution packet and an absorbent pad according to an embodiment of the invention.

Referring now to FIG. 11, the package 100 can be coupled with an absorbent pad 126 comprising multiple layers for transporting and retaining fluid from the surface 102 and a solution packet 148. While the absorbent pad 126 and solution packet 148 are described with respect to the package 100 of the second embodiment, the combination can be used with any of the packages 200, 300 and 400.

Figure 12:
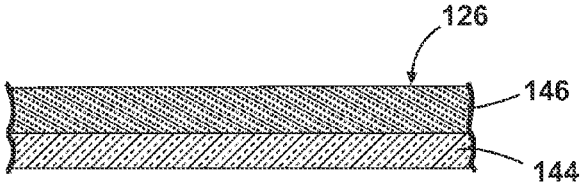
FIG. 12 is a cross-sectional view of an absorbent pad for use with a package according to any embodiment of the invention.

As illustrated in FIGS. 11 and 12, the absorbent pad 126 can comprise a transport layer 144 adjacent the surface 102 and an absorptive storage layer 146 disposed between the transport layer 144 and the lower face 118 of the base 104. The transport layer 144 can be made from a bonded carded web that can provide capillary action to transport fluid from the surface 102 to the absorptive storage layer 146. The absorptive storage layer 146 can be a super absorptive non-woven layer. For example, the absorptive storage layer 146 can be a mixture of fibrous pulp and a super-absorbent polymer, such as sodium polyacrylate.

The absorbent pad 126 can be provided with apertures that align with the needles 138 to facilitate positioning the absorbent pad 126 on the lower face 118 of the package 100, although it is within the scope of the invention for the absorbent pad 126 to not have apertures. The absorbent pad 126 can be slid onto the needles 138 and secured to the lower face 118 of the package 100. For example, the lower face 118 can be provided with finger-like projections to engage the surface of the absorbent pad 126 and hold it in place.

The number and type of layers in the absorbent pad 126 can be determined based on the type of stain being treated. For example, an absorbent pad 126 designed for use on moist stains that have a large amount of staining liquid can be provided with an additional or larger absorptive storage layer 146 to absorb the staining liquid.

Alternatively, one or more needles 138 can be provided with projections or barbs located along the length of the needle 138 to engage the absorbent pad 126 and secure it to the lower face 118. The absorbent pad 126 can be provided with any suitable thickness such that it can be secured adjacent to the lower face 118 and the needles 124 can project through the absorbent pad 126.

Figure 13A:
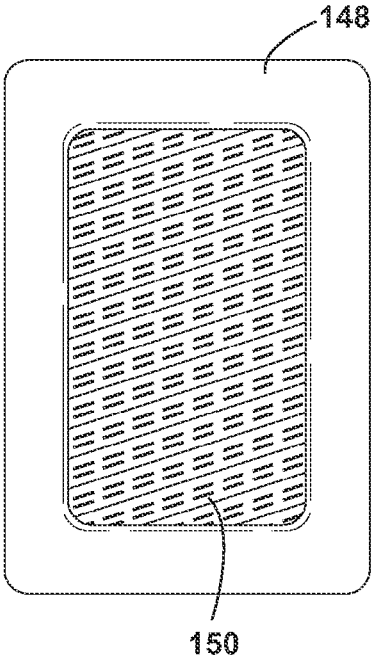
FIG. 13A is a perspective view of a solution packet according to any embodiment of the invention.

The packages 10, 100, 200, 300 and 400 according to the preceding embodiments can also be coupled with a solution packet 148 for delivering a solution to the surface 102. While the solution packet 148 is described with respect to the package 100 of the second embodiment, it can be used with any of the packages disclosed herein. As illustrated in FIG. 13A, the solution packet 148 can comprise a cleaning solution encased within a sealed, pierceable compartment 150 made from a suitable plastic, foil, or fiber-based material. The solution packet 148 can be sized so as to be received within the pocket 129. The solution packet 148 can also be sized so that multiple packets 148 can be received within the pocket 129. The compartment 150 can be made in any suitable manner. For example, the compartment 150 can be formed by heating sealing peripheral edge portions of the solution packet 148.

Figure 13B:
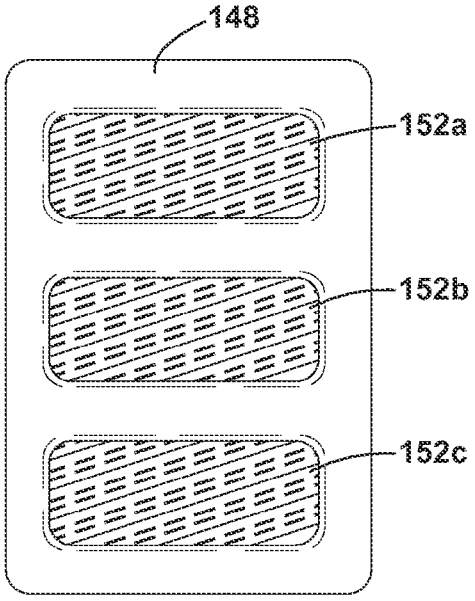
FIG. 13B is a perspective view of a solution packet having three compartments according to any embodiment of the invention.
Figure 13C:
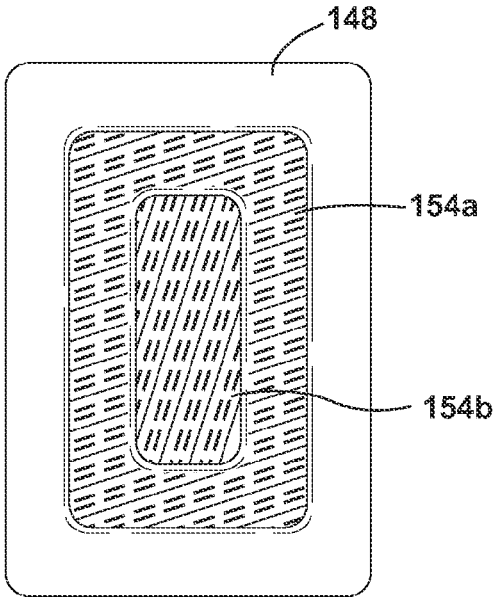
FIG. 13C is a perspective view of a solution packet having two compartments according to any embodiment of the invention.

As illustrated in FIGS. 13B and 13C, the solution packet 148 can also be divided into two or more compartments containing predetermined combinations of solutions. For example, as illustrated in FIG. 13B, the solution packet 148 can be divided into three sealed, pierceable compartments, 152*a*, 152*b*, 152*c*, each containing a different type of solution. FIG. 13C illustrates another example in which the solution packet 148 is divided into two sealed, pierceable compartments, 154*a* and 154*b*, in which compartment 154*a* circumferentially surrounds compartment 154*b*. It is within the scope of the invention for the solution packet 148 to be subdivided into any number of sealed compartments.

The solution is not limited to any particular type of solution and may comprise a surfactant-based cleaner, an enzyme-based cleaner, an oxidizing composition, an anti-soil and/or anti-stain composition, a botanical or synthetic disinfectant, a deodorizer, a fragrance or any combination thereof.

The solution packets 148 can be provided with solutions tailored for specific cleaning needs, such as for treating a pet stain or for removing a juice stain or for treating fresh, moist stains compared to older, dried stains. The user can also combine one or more solution packets 148 having solutions for specific cleaning situations depending on their needs. The solution packets 148 can be sold individually or as kits with suggestions for use and suitable combinations.

For example, a user can combine a packet designed for removing a juice stain with a packet comprising an anti-soil/anti-stain solution to remove the stain and treat the surface with an anti-soil/anti-stain treatment in one-step. In another example, a user can combine a packet designed for removing a pet stain with a deodorizer packet for removing the pet stain and eliminating pet odor in one step.

Providing the solution packet 148 with multiple compartments can provide a single solution packet 148 that can comprise different combinations of solutions, which may be tailored for specific cleaning needs. Because the compartments are sealed, the different solutions can be kept separate until the user is ready to use the solution packet 148 to treat a surface. This can lead to an increase in shelf life for some types of solutions, such as oxidizing solutions, for example, and can also allow solutions that are typically not stored together to be stored as a single unit and dispensed together.

An example method for using the package 100 will now be described according to an embodiment of the invention. If the user desires to use the package 100 with the absorbent pad 126, the user can first secure the absorbent pad 126 to the lower face 118 by sliding it over the needles 138 until it is adjacent the lower face 118. It is also within the scope of the invention to use the package 100 without the absorbent pad 126.

The user then centers the package 100 over the area to be cleaned on the surface 102 in the cocked position as illustrated in FIG. 4B. As the user pushes the package 100 into its locked position, as illustrated in FIG. 4A, the securing feet 116 move downward into and laterally within the pile 122, facilitating securing the package 100 in close proximity to the surface 102.

The length of the securing feet 116 and the needles 138 and the thickness of the absorbent pad 126 can be provided so that when the package 100 is in the locked position as illustrated in FIG. 4A, the absorbent pad 126 is in contact with the surface 102 and the needles 138 project into the pile 122 partially or fully to the backing 120.

The solution packet 148 can be placed on the package 100 while it is in the cocked or locked position. In either position, the user places the solution packet 148 in the pocket 129 and tucks the ends of the solution packet 148 into the retention channel 136 to hold it in place, as illustrated in FIG. 11. In the cocked position, the user can push against the solution packet 148 to force the package 100 into the locked position. This pressure also pushes the solution packet 148 against the needle hubs 140, which can pierce the solution packet 148. The user can apply additional pressure after the package 100 is in the locked position to ensure that the solution packet has been pierced by using a hand, foot or other object, such as a book, for example.

Once the needle hubs 140 pierce the solution packet 148, the solution can flow from the packet 148 through the hollow interior of the needles 138 and onto the surface 102. The solution can also flow from the pierced packet 148 and onto the surface 102 through the porous portion 142 of the base 104.

The combination of an absorbent pad 126 and needles 138 to deliver the cleaning solution provides a flushing action that can increase the effectiveness and efficiency of the cleaning process. As soon as the package 100 is positioned over the area to be cleaned and put into the locked position, the absorbent pad 126 can start absorbing any concentrated soiling liquid from the surface. The needles 138 deliver the solution from the solution packet 148 within the pile 122 near or adjacent to the backing 120, away from the absorbent pad 126. This reduces immediate absorption of the solution by the absorbent pad 126 before it has diluted the soil. As the solution is dispensed and the soil is diluted, the solution-diluted soil will be absorbed by the absorbent pad 126, providing the flushing action.

As the solution is dispensed, the transport layer 144 provides the capillary action to facilitate transport of the solution and soil away from the surface 102 to the absorptive storage layer 146. As the solution and soil are absorbed, the absorptive storage layer 146 can swell, providing pressure on the transport layer 144 which can provide additional force to press it against the surface 102. This contact pressure can further facilitate transport of the solution and soil away from the surface 102 and into the absorptive storage layer 146.

The cleaning package 200 can be used according to the same method described above for the package 100 except that the solution packet 148 can be secured to the base 204 using the projection barbs 228 instead of the retaining channel 136 of the package 100. The solution packet 148 can be provided with a flange having apertures or pre-made areas of weakness for receiving the barbs 228.

The cleaning package 300 can also be used according to the same method described above for the package 100 except that the solution packet 148 can be secured to the base 304 using the retaining straps 328 instead of the retaining channel 136 of the package 100. If the strap 328 is in the form a single elastic strap, the user can pull on the strap, elastically deforming it, to provide clearance to insert the solution packet 148 under the strap 328. When the user releases the elastic strap 328 it can snap into place against the solution packet 148. The strap 328 can also comprise two pieces releasably coupled together by adjustable means such as a buckle or Velcro® that the user can use to secure the solution packet 148 to the package 300.

The cleaning package 400 can also be used according to the same method described above for the package 100 except that the solution packet 148 can be secured to the base 404 by a cover 428 instead of the retaining channel 136 of the package 100. The user can rotate the cover 428 about its hinge 431 into an open position to place the solution packet 148 onto the package 400 and then rotate the cover 428 into a closed position to secure the solution packet 148 in place. The cover 428 can also provide the compression force for piercing the solution packet 148 with the needles 438 in combination with or instead of the user applying the compression force with a hand or foot.

It is within the scope of the invention for the packages 100, 200, 300 and 400 to have a generally circular shape, as illustrated, or any other suitable shape, such as a generally rectangular, square or any other polygonal shape. While the packages 100, 200, 300 and 400 are described for use with a soft surface, such as a carpet or rug, the package is suitable for cleaning any type of hard surface, such as a hard floor, furniture or bathroom surface, for example, or a soft surface, such as upholstery, bedding, garments or drapery, for example.

It is also within the scope of the invention for any of the elements of the packages 100, 200, 300 and 400 to be used with any other embodiments described herein. For example, it is within the scope of the invention for the needles 138 of the package 100 to be used with the package 10. In addition, it is within the scope of the invention for any of the elements of the package 10 to be used with any other embodiments described herein. For example, it is within the scope of the invention for the housing of any of the packages 100, 200, 300 and 400 to include an annular flange, such as the annular flange 22 of package 10 to substantially isolate the area under the housing from the ambient atmosphere to reduce evaporation of the cleaning solution during the cleaning process.

Figure 14:
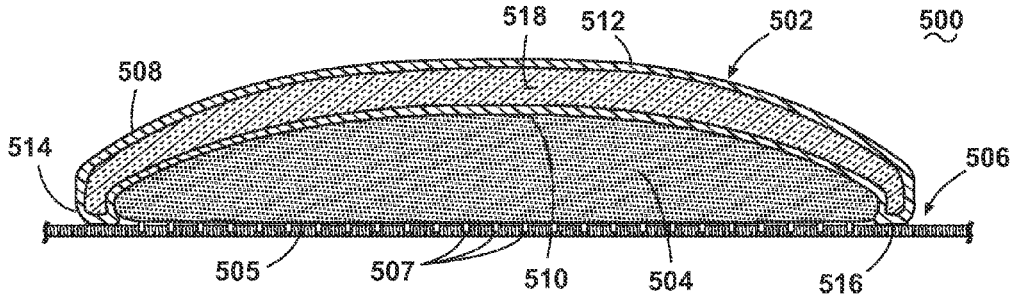
FIG. 14 is a cross-sectional view of a package for delivering a cleaning solution to a surface to be cleaned having an absorbent pad according to an embodiment of the invention.

FIG. 14 illustrates a cleaning package 500 according to a sixth embodiment of the invention. The cleaning package 500 comprises a liquid dispensing fluid shell 502 and a liquid absorbing insert 504. The fluid shell 502 can be a disposable or reusable blow molded shell that can contain a cleaning solution, such as those described in the previous embodiments. The fluid shell can be filled with any type of cleaning solution and is not limited to any particular type of solution and may comprise a surfactant-based cleaner, an enzyme-based cleaner, an oxidizing composition, an anti-soil and/or anti-stain composition, a botanical or synthetic disinfectant, a deodorizer, a fragrance or any combination thereof.

The liquid absorbing insert 504 can be a resilient hygroscopic gel material having a molded or formed shape comprising capillary fingers 507 that extend outwardly from the bottom surface 505 of the insert 504. The capillary fingers 507 can comprise a plurality of resilient hygroscopic gel protrusions that are integrally formed with the bottom side of the liquid absorbing insert 504. The depth of the capillary fingers 507 can be configured so that the fingers 507 engage a cleaning surface, such as carpet or rug fibers, for example. This arrangement increases the contact area and also enhances the physical proximity between the absorptive material and the fluid to be absorbed thereby improving the speed and thoroughness of fluid recovery and stain removal.

Numerous configurations of capillary fingers 507 are possible and representative, non-limiting alternatives are contemplated. The capillary fingers 507 can comprise non-woven cylindrical fabric fingers having an upper end inserted and retained in the bottom surface of the liquid absorbing insert 504 and a lower end for engaging a cleaning surface. In yet another configuration, the capillary fingers can comprise perforated plastic cylinders with an upper end retained in the absorbing insert 504 and a lower end for engaging a surface to be cleaned and further having an internal cavity that can hold absorptive polymer beads that can attract and absorb fluid. The cleaning package 500 can be placed on a surface 506 for dispensing and absorbing a cleaning solution.

The fluid shell 502 comprises an exterior portion 508 and an interior portion 510. The exterior portion 508 can have a generally concave upper portion 512 and an annular flange 514 extending from the upper portion 512. The annular flange 514 can be connected with the interior portion 510 through an inwardly extending lip 516. The exterior portion 508 and the interior portion 510 can define a deformable fluid chamber 518. The exterior portion 508 of the fluid shell 502 can also be coupled with a hard cover that partially or fully encompasses the exterior portion 508.

Figure 15:
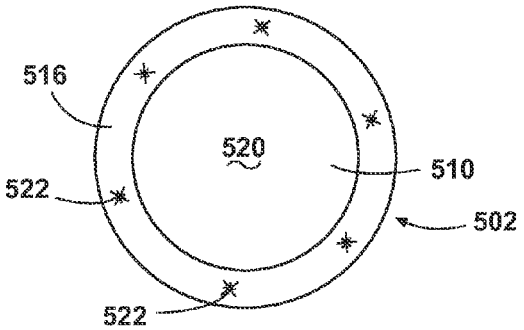
FIG. 15 is a bottom view of the package of FIG. 14 according to an embodiment of the invention.

As illustrated in FIG. 15, the interior portion 510 can be shaped so as to form a pocket or pocket 520 having a single chamber for receiving the insert 504. One or more areas of pre-defined weakness or frangible points 522 can be located around the perimeter of the interior portion 510 near the annular flange 514, such as in the extending lip 516, for dispensing solution from within the fluid shell 502.

Figure 16:
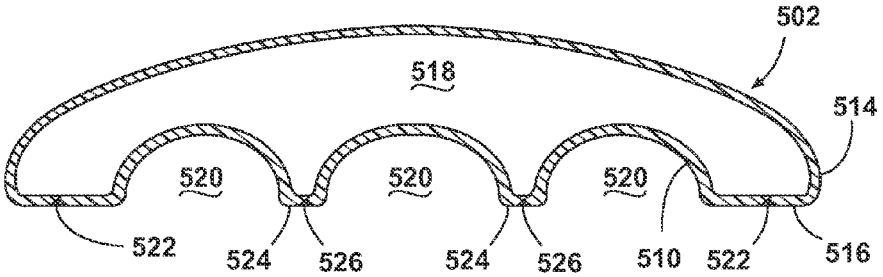
FIG. 16 is a cross-sectional view of a package for delivering a cleaning solution to a surface to be cleaned having an absorbent pad according to an embodiment of the invention.

Alternatively, as illustrated in FIG. 16, the interior portion 510 can also be shaped so as to form a pocket 520 having multiple chambers for receiving the insert 504. The interior portion 510 can be provided with one or more extensions 524 that can extend through the insert 504 towards the surface 506. The extensions 524 can define one or more chambers within the pocket 520. The distal ends of the extensions 524 can also have an area of pre-defined weakness or frangible point 526 for dispensing solution from within the fluid shell 502, similar to the frangible points 522 that can be provided in the lip 516.

The insert 504 is sized so as to be received within the pocket 520 of the fluid shell 502. The insert 504 can rest within the pocket 520 or it can be connected with the interior portion 510 by mechanical means, such as an interference fit, for example, or non-mechanical means, such as an adhesive, for example. The insert 504 can also be provided with one or more openings for aligning with the extensions 524, although it is within the scope of the invention for the insert 504 to not contain any openings.

Figure 17:
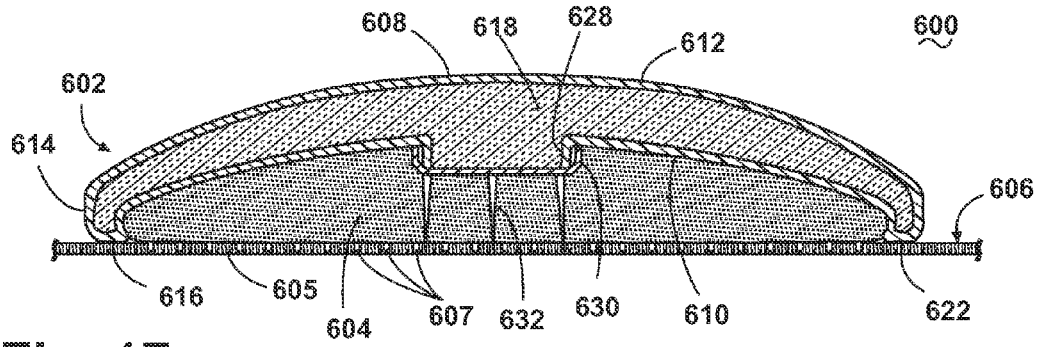
FIG. 17 is a cross-sectional view of a re-fillable package for delivering a cleaning solution to a surface to be cleaned having an absorbent pad according to an embodiment of the invention.

FIG. 17 illustrates a cleaning package 600 with a liquid dispensing fluid shell 602 and a liquid absorbing insert 604 according to a seventh embodiment of the invention. The package 600 is similar to the package 500 except for the fluid dispensing shell 602 comprises a resealable opening. Therefore, elements in the package 600 similar to those in the package 500 will be numbered with the prefix 600.

The fluid shell 602 can be a disposable or reusable blow molded shell that can contain a cleaning solution, such as those described in any of the preceding embodiments. The liquid absorbing insert 604 can be a resilient hygroscopic gel material having a molded or formed shape comprising capillary fingers 607 that extend outwardly from the bottom surface 605 of the insert 604. The capillary fingers 607 can comprise a plurality of resilient hygroscopic gel protrusions that are integrally formed with the bottom side of the liquid absorbing insert 604. The depth of the capillary fingers 607 can be configured so that the fingers 607 engage a surface to be cleaned, such as carpet or rug fibers. This arrangement increases the contact area and also enhances the physical proximity between the absorptive material and the fluid to be absorbed thereby improving the speed and thoroughness of fluid recovery and stain removal.

Numerous configurations of capillary fingers 607 are possible and representative, non-limiting alternatives are contemplated. The capillary fingers 607 can comprise non-woven cylindrical fabric fingers having an upper end inserted and retained in the bottom surface of the liquid absorbing insert 604 and a lower end for engaging a cleaning surface. In yet another configuration, the capillary fingers can comprise perforated plastic cylinders with an upper end for retention in the absorbing insert 604 and lower end for engaging a cleaning surface and further having an internal cavity that can hold absorptive polymer beads that can attract and absorb fluid through the perforated cylinder. The cleaning package 600 can be placed on a surface 606 for dispensing and absorbing a cleaning solution.

The fluid shell 602 can have an exterior portion 608 and an interior portion 610. The exterior portion 608 can have a generally concave upper portion 612 and an annular flange 614 extending from the upper portion 612. The annular flange 614 can be connected with the interior portion 610 through an inwardly extending lip 616. The exterior portion 608 and the interior portion 610 define a deformable fluid chamber 612. The exterior portion 608 of the fluid shell 602 can also be connected with a hard cover that partially or fully encompasses the exterior portion 608.

The interior portion 610 can be shaped so as to form a pocket or cavity 620 for receiving the insert 604. The interior portion 610 of the fluid shell 602 can encompass the insert 604 and extend over the top and around the sides of the insert 604. One or more areas of pre-defined weakness or frangible points 622 can be located around the perimeter of the interior portion 610 in the lip 616 for dispensing solution from within the fluid shell 602.

The interior portion 610 can also be provided with a resealable opening 628 having a cap 630 that provides selective access to the fluid chamber 618. The cap 630 can be in the form of a threaded screw cap or a snap-fit cap, for example. The cap 630 can also be provided with one or more hollow projections 632 that can extend from the cap 630 through the insert 604 and project towards the surface 606. The hollow projections 632 can fluidly couple the contents of the fluid chamber 618 with the surface 606. The projections 632 can be provided unimpeded at both ends. Alternatively, one end of the hollow projections 618 can be covered with a material having an area of pre-defined weakness or a frangible point. It is also within the scope of the invention for the cap 630 to not have the projections 632.

The insert 604 is sized so as to be received within the pocket 620 of the fluid shell 602. The insert 604 can rest within the pocket 620 or it can be connected with the interior portion 610 by mechanical means, such as an interference fit, for example, or non-mechanical means, such as an adhesive, for example. The insert 604 can also be provided with one or more openings that align with the projections 632, although it is within the scope of the invention for the insert 604 to not contain any openings.

An example method for using the cleaning package 500 will now be described according to an embodiment of the invention. While the method is described in the context of the cleaning package 500, the method can also be used with the package 600. The package 500 can be provided to the user with the fluid shell 502 and the absorbent insert 504 pre-assembled or the package 500 can be assembled by the user. A variety of disposable fluid shells 502 can be provided to the user comprising solutions for specific cleaning needs, such as for treating a pet stain or for removing a juice stain. The fluid shells 502 can be provided to the user in pre-assembled kits comprising different solutions for specific cleaning needs that the user can use with the absorbent insert 504.

Once the cleaning package 500 is assembled, it can be placed on the surface 506 over the soiled area to be cleaned. To apply the solution within the fluid shell 502 to the surface 506, the user can press down on the cleaning package 500 using a hand, foot or other object, such as a book, for example. The pressure applied by the user forces the solution through the frangible points 522 and/or 524, if present, in the fluid shell 502. The solution can then leak out of the fluid shell 502 onto the soiled area and dilute the soil.

As soon as the package 500 is positioned over the soiled area the absorbent insert 504 can start absorbing any concentrated soiling liquid from the surface. The absorbent insert 504 continues to absorb the soil as it is diluted by the solution dispensing from the fluid shell 502, providing a flushing action that can increase the effectiveness and efficiency of the cleaning process. The capillary fingers of the absorbent insert 504 facilitate transfer of the soil and solution-diluted soil from the surface 506 into the absorbent insert 504.

The cleaning package 600 can be used in a similar way, except that the fluid shell 602 can be re-usable instead of disposable. The fluid shell 602 can be re-filled by the user through the resealable opening 628. The user can be provided with a variety of pre-made solutions tailored for specific cleaning needs, such as for treating a pet stain or for removing a juice stain. The user can also combine one or more pre-made solutions for specific cleaning situations depending on their needs. The pre-made solutions can be sold individually or as kits with suggestions for use and suitable combinations.

For example, a user can combine a solution designed for removing a juice stain with a solution comprising an anti-soil/anti-stain solution to remove the stain and treat the surface with an anti-soil/anti-stain treatment in one-step. In another example, a user can combine a solution designed for removing a pet stain with a deodorizer solution for removing the pet stain and eliminating pet odor in one step.

The inventive packages described herein provide one step treatment and removal of soiled and excess liquid, saving the user time and diminishing the manual labor involved using traditional solutions comprising stain removal and/or treatment chemistries that require the user to scrub, blot or vacuum the treated area. The combination of applying the solution at the base of the surface and absorbing the soiled and excess solution as it is applied provides a flushing action that improves the removal of soil and stains from the surface being cleaned. Applying the solution at the base of the fabric, away from the absorbent materials minimizes absorption of the solution before it has interacted with the surface being cleaned. The packages can also provide an enclosed environment around the treated area to minimize evaporation, further improving the removal of soil and stains from the surface being cleaned. In addition, the packages allow a user to selectively tailor the applied cleaning solutions based on the specific cleaning needs of the user.

While the invention has been specifically described in connection with certain specific embodiments thereof, it is to be understood that this is by way of illustration and not of limitation. Reasonable variation and combination are possible with the scope of the foregoing disclosure without departing from the spirit of the invention, which is defined in the appended claims.

What is claimed is:

1. A package for delivering a cleaning solution to a surface to be cleaned comprising:

a sealed packet having a cleaning solution therein and a lowermost surface configured to rest on the surface to be cleaned, with at least a portion of the lowermost surface having at least one weakened, frangible area that is adapted to rupture when a predetermined pressure is applied to an upper surface of the packet;

wherein the cleaning solution in the packet is discharged directly to the surface to be cleaned through the at least one frangible area in the lowermost surface when the packet is positioned on the surface to be cleaned and the predetermined pressure is applied to the packet to rupture the packet;

wherein the packet has an absorbent material, the sealed packet comprises a pocket for receiving the absorbent material, the lowermost surface extends around a perimeter of the pocket, and multiple frangible areas are located in the lowermost surface around the perimeter of the pocket.

2. The package of claim 1 wherein the packet has a dome shape defining the pocket, with the frangible areas spaced around a perimeter of the dome shaped packet.

3. The package of claim 1 wherein the packet has a dome shape with at least one downwardly extending member defining multiple pockets.

4. The package of claim 3 wherein frangible areas are located on a perimeter of the dome shaped packet and on the at least one downwardly extending member.

5. The package of claim 1 wherein the packet has an opening and a cover for resealably closing the opening.

6. The package of claim 1 wherein the absorbent material comprises capillary fingers that protrude towards a surface to be cleaned.

7. The package of claim 6 wherein the capillary fingers comprise a resilient hygroscopic gel.

8. The package of claim 1 wherein the absorbent material is a hygroscopic gel.

9. The package of claim 1 wherein the cleaning solution comprises at least one of a solvent, a surfactant, an enzyme, an oxidizing agent, an anti-soil agent, an anti-stain agent, a disinfectant, a deodorizer, a fragrance or combinations thereof.

10. The package of claim 1 wherein the absorbent material is laterally disposed to the at least one frangible area, such that the cleaning solution in the packet can be discharged directly to the surface to be cleaned through the at least one frangible area without encountering the absorbent material.

11. A package for delivering a cleaning solution to a surface to be cleaned comprising:

a sealed packet having a cleaning solution therein and a lowermost surface configured to rest on the surface to be cleaned, with at least a portion of the lowermost surface having at least one weakened, frangible area that is adapted to rupture when a predetermined pressure is applied to an upper surface of the packet;

wherein the cleaning solution in the packet is discharged directly to the surface to be cleaned through the at least one frangible area in the lowermost surface when the packet is positioned on the surface to be cleaned and the predetermined pressure is applied to the packet to rupture the packet;

wherein the packet has an opening and a cover for resealably closing the opening; and wherein the cover has at least one downwardly extending hollow projection for dispensing the cleaning solution from the packet to the surface to be cleaned.

12. The package of claim 11 wherein the at least one frangible area comprises multiple frangible areas located in spaced relationship on the lowermost surface.

13. A package for delivering a cleaning solution to a surface to be cleaned comprising:

a sealed packet defining a deformable fluid chamber having a bottom wall configured to rest on the surface to be cleaned and comprising a pocket, wherein the bottom wall extends around a perimeter of the pocket;

a cleaning solution within the deformable fluid chamber; and an absorbent material received by the pocket;

multiple frangible areas located in the bottom wall around the perimeter of the pocket, wherein at least one of the frangible areas is adapted to rupture when a predetermined pressure is applied to the packet;

wherein the cleaning solution is discharged from the fluid chamber directly to the surface to be cleaned through the at least one frangible area in the bottom wall when the packet is positioned on the surface to be cleaned and the predetermined pressure is applied to the packet to rupture the packet.

14. The package of claim 13, wherein the absorbent material is laterally disposed to the frangible areas.

* * * * *